US011215089B2

(12) United States Patent
Krieger et al.

(10) Patent No.: US 11,215,089 B2
(45) Date of Patent: Jan. 4, 2022

(54) ENGINE HEAD ASSEMBLY WITH VALVE SEAT INSERT WITH STIFFNESS RELIEF CUTOUT

(71) Applicant: Caterpillar Inc., Peoria, IL (US)

(72) Inventors: Jeffrey Clark Krieger, Brimfield, IL (US); Michael Dean Roley, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 74 days.

(21) Appl. No.: 16/713,633

(22) Filed: Dec. 13, 2019

(65) Prior Publication Data

US 2021/0180478 A1 Jun. 17, 2021

(51) Int. Cl.

| | |
|---|---|
| ***F01L 3/22*** | (2006.01) |
| ***F01L 3/02*** | (2006.01) |
| ***F01L 3/20*** | (2006.01) |
| ***F02F 1/42*** | (2006.01) |
| *F01L 3/00* | (2006.01) |

(52) U.S. Cl.

CPC *F01L 3/02* (2013.01); *F01L 3/20* (2013.01); *F02F 1/4285* (2013.01); *F01L 2003/253* (2013.01); *F01L 2303/00* (2020.05)

(58) Field of Classification Search

CPC ..... F01L 3/22; F01P 3/14; F02F 2001/008; Y10T 29/49306

USPC ..... 123/188.2; 29/888.46, 888.4, 888.44; 251/361, 365, 359

See application file for complete search history.

(56) References Cited

U.S. PATENT DOCUMENTS

| | | | | |
|---|---|---|---|---|
| 2,007,543 A * | 7/1935 | Meeker | F01L 3/22 | 123/188.8 |
| 2,406,963 A * | 9/1946 | Norton | B21K 25/00 | 123/188.8 |
| 2,517,114 A * | 8/1950 | Karcher | F01L 3/22 | 123/188.8 |
| 2,665,675 A * | 1/1954 | Sheppard | F01L 3/22 | 123/188.8 |
| 3,046,965 A * | 7/1962 | Kauffmann | F01L 3/22 | 123/188.8 |
| 4,106,466 A * | 8/1978 | Goloff | F01L 3/22 | 123/188.8 |

(Continued)

FOREIGN PATENT DOCUMENTS

| | | |
|---|---|---|
| CN | 202418650 U | 9/2012 |
| DE | 3714229 | 11/1988 |

(Continued)

*Primary Examiner* — George C Jin
*Assistant Examiner* — Teuta B Holbrook
(74) *Attorney, Agent, or Firm* — Brannon Sowers & Cracraft

(57) ABSTRACT

An engine head assembly includes a valve seat insert having a valve seating surface defining a center axis, and each of an inner peripheral surface and an outer peripheral surface extending circumferentially around the valve seat center axis. The outer peripheral surface includes an upper section interference-fitted with the engine head, and a lower section. A stiffness relief channel is formed by a relief cutout in the valve seat insert, and extends radially between the lower section of the outer peripheral surface and the engine head. The stiffness relief channel permits flexing of the valve seat insert to cushion valve seating to prolong engine valve and valve seat insert service life.

18 Claims, 3 Drawing Sheets

(56) References Cited

U.S. PATENT DOCUMENTS

| | | | | | |
|---|---|---|---|---|---|
| 4,236,495 | A | * | 12/1980 | Rosan, Jr. | F01L 3/22 123/188.8 |
| 4,676,482 | A | * | 6/1987 | Reece | F01L 3/22 251/365 |
| 4,763,876 | A | | 8/1988 | Oda et al. | |
| 4,831,976 | A | * | 5/1989 | Pozniak | F01L 3/22 123/188.8 |
| 2014/0190441 | A1 | | 7/2014 | Chern et al. | |
| 2016/0258538 | A1 | | 9/2016 | Liu | |

FOREIGN PATENT DOCUMENTS

| | | |
|---|---|---|
| DE | 10354480 | 6/2005 |
| JP | 8270417 A | 10/1996 |

* cited by examiner

ENGINE HEAD ASSEMBLY WITH VALVE SEAT INSERT WITH STIFFNESS RELIEF CUTOUT

TECHNICAL FIELD

The present disclosure relates generally to a valve seat insert in an internal combustion engine, and more particularly to a valve seat insert having a stiffness relief cutout to cushion seating of an engine valve.

BACKGROUND

Gas exchange valves are used in internal combustion engines to control fluid connections between the cylinder and a supply of intake air or intake air and other gases, such as recirculated exhaust, or between the cylinder and an exhaust manifold for expelling combustion products. Designs are known where a single intake valve and a single exhaust valve are associated with each cylinder in an engine, as well as designs where multiple gas exchange valves of each type are associated with each cylinder. A camshaft, typically rotated at half engine speed, is coupled with valve lifters, bridges, rocker arms, and/or other equipment for opening and closing gas exchange valves at appropriate engine timings.

Such valves are typically moved into contact and out of contact with the engine head or a valve seat insert within the engine head to open and close, and can be moved between opened and closed positions with significant mechanical forces. During operation, engine cylinders and associated hardware, including gas exchange valves and valve seat inserts, can experience temperatures of several hundred degrees Celsius and relatively high fluid pressures. For these and other reasons, gas exchange valve operating conditions can be quite harsh. Gas exchange valves and valve seat inserts can experience undesired wear and/or material deformation over the course of a service life of the engine, or between service intervals.

A gas exchange valve and its valve seat can contact one another in the millions or potentially billions of times between planned service intervals. In some instances, material of the components wears away, is displaced, or the components themselves can otherwise deform. A phenomenon known as valve recession relates to an engine valve receding toward or into the engine head over time. In other instances, material can be transferred from a desired location by way of adhesion between the hot valve head and valve seat insert during service, and alter the pattern of contact between the components in an undesired manner. Engineers have experimented with a variety of different techniques attempting to address the extent and effects of various valve and valve seat wear phenomena. In Japanese Patent Application Publication No. JP8270417A, a convex surface is provided that bulges toward a seat surface of a valve face to address local wear problems.

SUMMARY OF THE INVENTION

In one aspect, an engine head assembly includes an engine head having a fireside surface structured to face a cylinder in an engine, and the engine head having formed therein a valve seat bore, and a gas exchange conduit connecting to the valve seat bore. The engine head assembly further includes a valve seat insert having a valve seating surface defining a center axis, a first axial end abutting the engine head within the valve seat bore, and a second axial end. The engine head assembly still further includes a gas exchange valve having a valve head, and being movable between a closed valve position where the valve head contacts the valve seating surface, and an open valve position. The valve seat insert further includes an inner peripheral surface extending circumferentially around the center axis and forming a throat, for communicating gases between the gas exchange conduit and the cylinder, and an outer peripheral surface. The outer peripheral surface includes an upper section adjacent to the first axial end and interference-fitted with the engine head within the valve seat bore, and a lower section extending between the upper section and the second axial end. A stiffness relief channel extends radially between the lower section of the outer peripheral surface and the engine head. The stiffness relief channel is circumferential of the valve seat insert and opens in a direction of the fireside surface.

In another aspect, a valve seat insert for a gas exchange valve controlling gas exchange of a cylinder in an engine includes an annular insert body formed of a metallic material and having an inner peripheral surface, an outer peripheral surface, and a valve seating surface. The valve seating surface defines a center axis extending between a first axial end and a second axial end of the annular insert body. The inner peripheral surface extends circumferentially around the center axis and forms a throat, for communicating gases between a cylinder in the engine and a gas exchange conduit in an engine head in the engine. The outer peripheral surface extends circumferentially around the center axis, and includes an upper section adjacent the first axial end, and a lower section extending between the upper section and the second axial end. The upper section has a full outer diameter dimension, and a cylindrical shape, for interference-fitting the annular insert body in a valve seat bore in the engine head. The lower section has a reduced outer diameter dimension, relative to the upper section, such that the outer peripheral surface is stepped radially inward from the upper section to the lower section, and forms a relief cutout for limiting a stiffness of the valve seat insert.

In still another aspect, a valve seat insert for a gas exchange valve controlling gas exchange of a cylinder in an engine includes an annular insert body formed of a metallic material and including an inner peripheral surface, an outer peripheral surface, and a valve seating surface. The valve seating surface defines a center axis extending between a first axial end and a second axial end of the annular insert body. The inner peripheral surface extends circumferentially around the center axis and forms a throat, for communicating gases between a cylinder in the engine and a gas exchange conduit in an engine head in the engine. The outer peripheral surface extends circumferentially around the center axis, and includes an upper section adjacent the first axial end, and a lower section. The upper section has a full outer diameter dimension, and a cylindrical shape, for interference fitting the annular insert body in a valve seat bore in the engine head. The lower section has a reduced outer diameter dimension, relative to the upper section, and forms a relief cutout that is continuous from the upper section of the outer peripheral surface to the second axial end.

DETAILED DESCRIPTION

Figure 1:
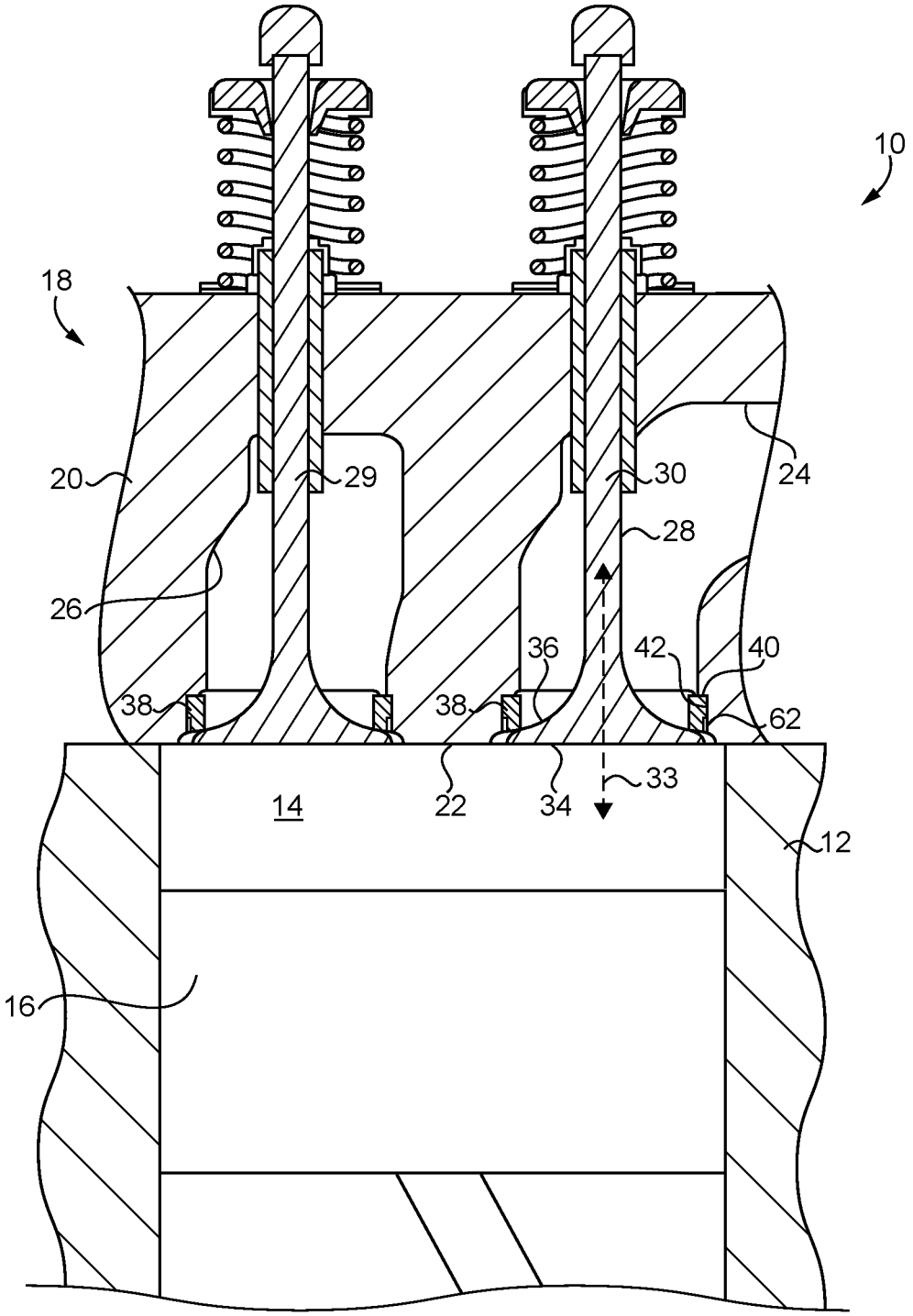
FIG. 1 is a sectioned side diagrammatic view of an engine having an engine head assembly, according to one embodiment.

Referring to FIG. 1 there is shown an internal combustion engine 10 according to one embodiment, and including a cylinder block 12 having a cylinder 14 formed therein. Internal combustion engine 10 (hereinafter "engine 10") could be any of a variety of engines including a compression-ignition diesel engine, a spark-ignited gasoline engine, a gaseous fuel engine structured to operate on a fuel that is delivered to cylinder 14 in gaseous form, a dual fuel engine, or still another. In a compression ignition diesel engine application, such as a direct-injected diesel engine, suitable fuels could include diesel distillate fuel, biodiesel, blends of these, or still others. An engine head assembly 18 includes an engine head 20 coupled to cylinder block 12. Engine head 20 has a first gas exchange conduit 24 and a second gas exchange conduit 26 formed therein. Gas exchange conduits 24 and 26 could each include an intake conduit structured to fluidly connect cylinder 14 with an intake manifold, or an exhaust conduit structured to fluidly connect cylinder 14 with an exhaust manifold, or one of gas exchange conduits 24 and 26 could be an intake conduit and the other an exhaust conduit. A piston 16 is positioned within cylinder 14 and structured to reciprocate between a top dead center position and a bottom dead center position in a generally conventional manner, such as in a four-cycle pattern. Piston 16 will be coupled with a crankshaft (not shown) also in a known manner. Engine 10 could include any number of cylinders arranged in any suitable configuration such as a V-configuration, an in-line configuration, or still another. Engine head 20 could be a monolithic engine head associated with all of a plurality of cylinders in engine 10, or could be a separate engine head section associated with less than all the cylinders such as only cylinder 14.

Engine head assembly 18 further includes a first gas exchange valve 28 and a second gas exchange valve 29 associated, respectively, with gas exchange conduits 24 and 26. Gas exchange valves 28 and 29 could be substantially identical, or different; however, description herein of gas exchange valve 28 and associated components in the singular should be understood to refer by way of analogy to gas exchange valve 29 and any other gas exchange valves in engine 10. Gas exchange valve 28 is shown more or less vertically oriented and defines a valve reciprocation axis 33. In other embodiments gas exchanged valve 28 could be diagonally oriented relative to a reciprocation direction of piston 16. Engine head 20 includes fireside surface 22 structured to face cylinder 14, and further has formed therein a valve seat bore 40, with gas exchange conduit 24 connecting to valve seat bore 40. Engine head 20 also includes an inner cylindrical bore surface 42 forming valve seat bore 40. Each of gas exchange valves 28 and 29 can be movable between a closed valve position blocking fluid communication between cylinder 14 and the respective gas exchange conduits 24 and 26, and an open valve position at which gas exchange can occur. Gas exchange valves 28 and 29 may be spring-biased towards closed positions, and opened in response to rotation of a camshaft.

Figure 2:
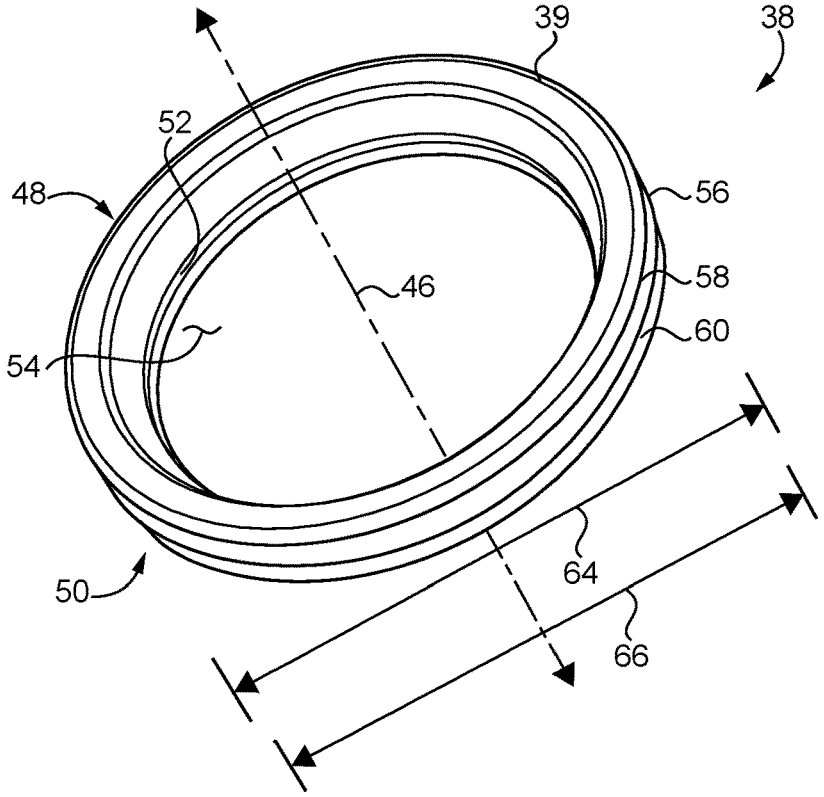
FIG. 2 is a perspective view of a valve seat insert, according to one embodiment.
Figure 3:
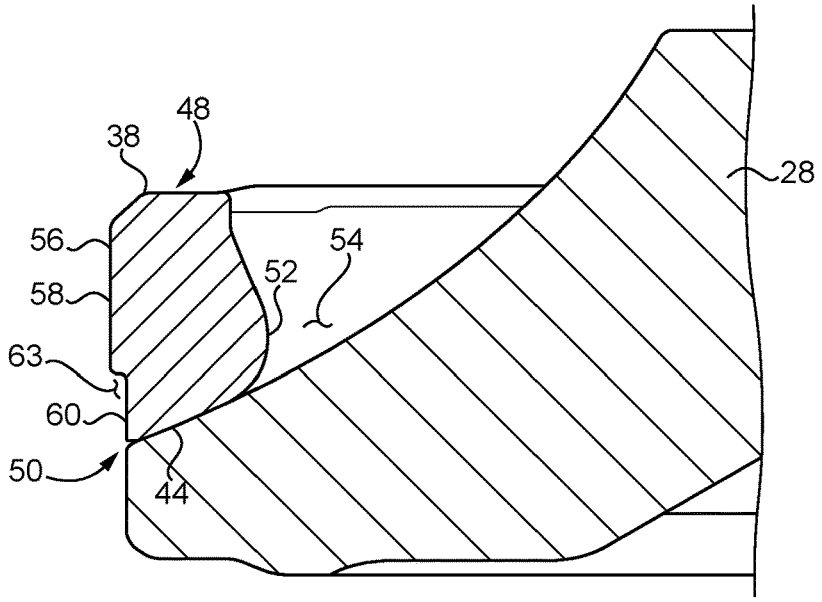
FIG. 3 is a sectioned side diagrammatic view of a valve seat insert and engine valve, according to one embodiment.

Engine head assembly 18 further includes a valve seat insert 38 positioned within valve seat bore 40. Another valve seat insert also shown by way of a reference numeral 38, associated with gas exchange conduit 26. The two valve seat inserts 38 may be substantially identical in at least some embodiments. Referring also now to FIGS. 2 and 3, valve seat insert 38 may be formed of a metallic material, such as a pressed steel or iron powdered metallic material, forming an annular insert body 39. Annular insert body 39 could alternatively be cast, or formed by any other suitable technique. Valve seat insert 38 includes a valve seating surface 44 having a conical shape and defining a center axis 46 extending between a first axial end 48 and a second axial end 50, of valve seat insert 38 and annular insert body 39. First axial end 48 abuts engine head 20 within valve seat bore 40. Gas exchange valve 28 includes a valve head 32 and a valve stem 30. At the closed valve position, valve head 32 contacts valve seating surface 44. An outer surface or combustion face 34 of valve head 32 is exposed to cylinder 14, and an inner surface 36 contacts valve seating surface 44 at the closed valve position.

Valve seat insert 38 further includes an inner peripheral surface 52 extending circumferentially around center axis 46 and forming a throat 54, for communicating gases between gas exchange conduit 24 and cylinder 14, and an outer peripheral surface 56. Outer peripheral surface 56 includes an upper section 58 adjacent to first axial end 48 and interference-fitted with engine head 20 within valve seat bore 40. A lead-in chamfer 83 is shown at first axial end 48. Upper section 58 is interference-fitted, in particular, with inner cylindrical bore surface 42, and has a cylindrical shape. Outer peripheral surface 56 also includes a lower section 60 extending axially between upper section 58 and second axial end 50.

As discussed above, contact between a gas exchange valve and a valve seat in an engine can subject the components to significant mechanical stress and strain, often at high temperatures. It has been observed that the amplitude and impulse of forces exerted between a valve and valve seat, and other factors, can lead to deformation, damage, undue wear, or other phenomena that result in performance degradation over time. According to the present disclosure, valve seat inserts and/or engine heads can be constructed to enable a reduced stiffness of a valve seat insert that can cushion contact between a valve head and valve seat insert during closing a gas exchange valve.

To this end, a stiffness relief channel 62 extends radially between lower section 60 of outer peripheral surface 56 and engine head 20, with stiffness relief channel 62 being circumferential of valve seat insert 38 and opening at second axial end 50 in a direction of fireside surface 22. It will be recalled that valve seat bore 40 may be formed by inner cylindrical bore surface 42. An axial extent of inner cylindrical bore surface 42 may be such that lower section 60 faces inner cylindrical bore surface 42, and is spaced in a radial direction, relative to center axis 46, from upper section 58 to form a relief cutout 63 in valve seat insert 38. Relief cutout 38 together with inner cylindrical bore surface 42, forms stiffness relief channel 62. Relief cutout 63 may be continuous from upper section 58 to second axial end 50.

In some embodiments, no modification to an existing engine head design is needed to provide stiffness relief channel 62, with a purpose-built valve seat insert being fitted into a cylindrical valve seat bore to form relief channel 62. In other embodiments, relief channel 62 could be formed in whole or in part in an engine head, with an outer peripheral surface of a valve seat insert being uniformly cylindrical. It will be recalled that upper section 58 is interference-fitted with engine head 20. Providing relief channel 62/cutout 63 results in effectively less axial length of valve seat insert 38 that is interference-fitted, and permits valve seat insert 38 to elastically deform in response to closing contact with gas exchange valve 28. Certain additional structural features and refinements to valve seat insert 38 as further discussed herein provide practical implementation strategies.

Figure 4:
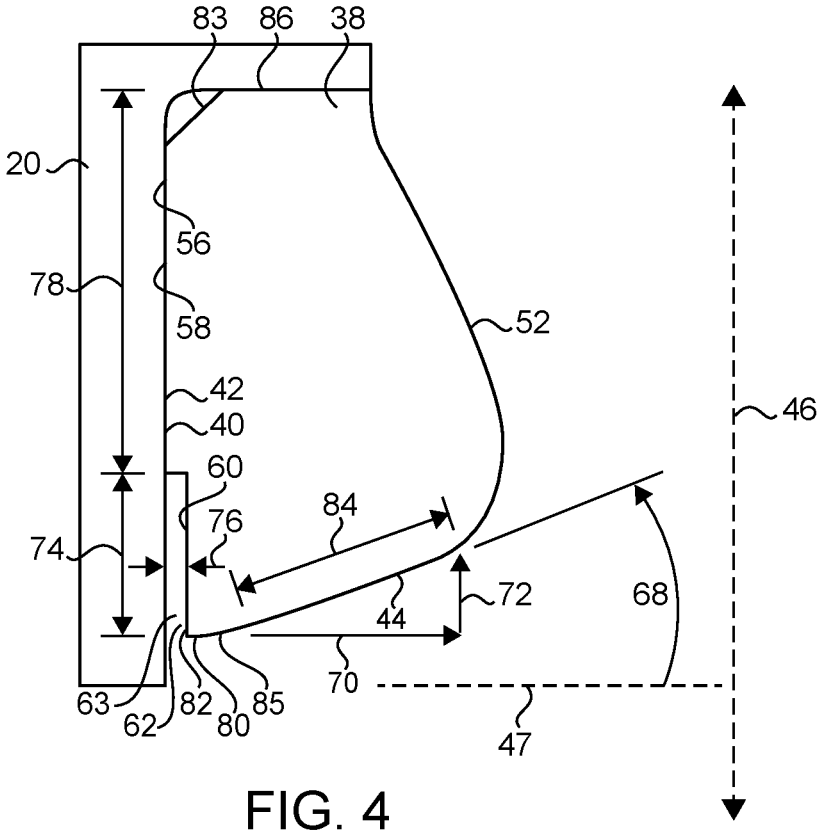
FIG. 4 is a sectioned side diagrammatic view of a valve seat insert installed in an engine head, according to one embodiment.

Referring also now to FIG. 4, lower section 60 of outer peripheral surface 56 may be cylindrical and concentric with inner cylindrical bore surface 42, with each of inner cylindrical bore surface 42 and outer peripheral surface 56 being centered on center axis 46. Stiffness relief channel 62 and relief cutout 63 may each have a uniform profile of rotation circumferentially around center axis 46, meaning that a cross-sectional profile shape of stiffness relief channel 62, and of relief cutout 63, may be the same at every circumferential location upon valve seat insert 38.

Relief cutout 63 may also have a radial width dimension 76, and an axial length dimension 74 that is greater than radial width dimension 76. Radial width dimension 76 extends along the radius of a circle centered on center axis 46. Axial length dimension 74 is parallel to center axis 46. Axial length dimension 74 may also be less than a second axial length dimension 78 of upper section 58 of outer peripheral surface 56, such that a majority of a full axial length of outer peripheral surface 56 is interference-fitted with inner cylindrical bore surface 42. Axial length dimension 74 may further be less than an interference-fitted axial length of upper section 58 with engine head 20. As best shown in FIG. 2, upper section 58 has a full outer diameter dimension 64, and lower section 60 has a reduced outer diameter dimension 66, relative to upper section 58, such that outer peripheral surface 56 is stepped radially inward from upper section 58 to lower section 60, to form relief cutout 63. It can also be noted from FIG. 4 that second axial end 50 includes a planar end surface 80 located radially outward of valve seating surface 44. Lower section 60 of outer peripheral surface 56 and planar end surface 80 form a common edge 82. In the embodiment of FIG. 4, valve seating surface 44 advances from second axial end 50 toward inner peripheral surface 52 in a seat path and at a seat angle 68. Seat angle 68 may be from about 19° to about 45°, and more particularly from about 20° to about 44°. Seat angle 68 in the embodiment of FIG. 4 may be about 20°. The term "about" can be understood to mean generally, or approximately, or within measurement error, as will be understood by a person of ordinary skill in the relevant art. The seat path formed by valve seating surface 44 has a radial path component 70 and an axial path component 72. Axial length dimension 74 of relief cutout 63 may be equal to or greater than axial path component 72. Stated another way, lower section 60 may advance axially inward from second axial end 50 to a greater relative extent than does valve seating surface 44. Axially inward means a direction parallel to an axis, and toward a geometric center point of the relevant reference item, in the subject case valve seat insert 38.

Figure 5:
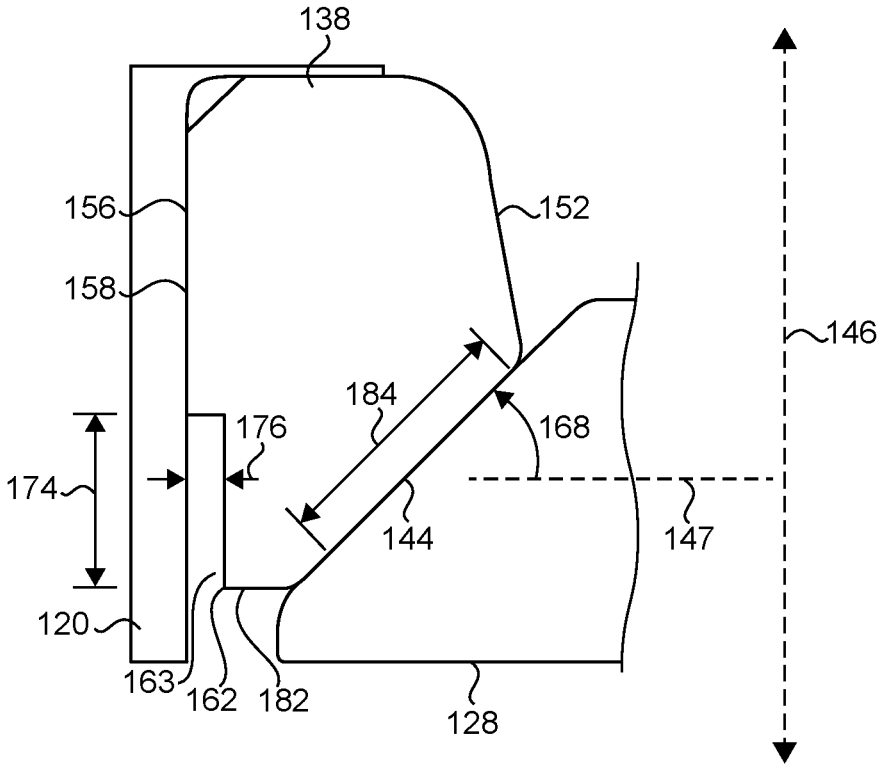
FIG. 5 is a sectioned side diagrammatic view of a valve seat insert installed in an engine head, and an engine valve, according to another embodiment.

Referring now to FIG. 5, there is shown a valve seat insert 138 according to another embodiment, and having certain similarities with valve seat insert 38 heretofore described, but also certain differences. Valve seat insert 138, and for that matter valve seat insert 38 discussed above, may be used with so-called overhung valves approximately as shown. Each may also be structured such that an interference angle is formed between the valve and valve seat, at least prior to breaking in, although the present disclosure is not thereby limited. Valve seat insert 138 includes an inner peripheral surface 152 and an outer peripheral surface 156 each extending circumferentially around a center axis 146 defined by a valve seating surface 144. A relief cutout 163, together with an engine head 120, forms a stiffness relief channel 162 extending circumferentially around center axis 146. Stiffness relief channel 162 may be formed by a lower section 160 of outer peripheral surface 156. Outer peripheral surface 156 is stepped inwardly from an upper section 158 of outer peripheral surface 156 to lower section 160. In FIG. 5 a gas exchange valve 128 is shown as it might appear contacting valve seating surface 144. Relief cutout 163 includes an axial length dimension 174 and a radial width dimension 176. Axial length dimension 174 may be less than a majority of an axial extent of outer peripheral surface 156, and less than an interference-fitted length of outer peripheral surface 156 with engine head 120. A planar end surface 182 is formed on valve seat insert 138 between valve seating surface 144 and relief cutout 163. Valve seating surface 144 is oriented at a seat angle 168 that may be from about 19° to about 45°, and in the illustrated embodiment is about 44°. Other features of valve seat insert 138 may be similar or in some cases identical to valve seat insert 38 discussed above.

In the case of seat angle 68 in the embodiment of FIG. 4 and seat angle 168 in the embodiment of FIG. 5, the respective seat angles are measured relative to planes 47 and 147, respectively, that are perpendicular to the respective center axis 46 and 146. Valve seating surface 44 has a seat length dimension 84 and valve seating surface 144 has a seat length dimension 184. Seat length dimensions 84 and 184 may be from about 2 millimeters to about 5 millimeters, and more particularly from about 3 millimeters to about 4 millimeters. Radial width dimension 76 and radial width dimension 176 may be less than, for instance equal to about 50% or less, of the respective seat length dimension 84 and 184, and in a refinement about 25% or less. It may generally be desirable to limit a radial extent of relief cutouts 63 and 163 to preserve planar end surfaces 82 and 182, rather than forming relief cutouts 63 and 163 so deep that insufficient space exists for forming at least some planar end surface for machining locating purposes or for other reasons. In some implementations, relief cutouts 63 and 163 may be relatively shallow radially, removing only as much material in a machining cutout as is necessary for lower sections 60 and 160 to be nominally not in contact with inner cylindrical bore surfaces 42 and 142. In the embodiment of FIG. 4, a curved surface 85 is shown that transitions between valve seating surface 44 and planar end surface 80. Valve seat insert 138 may have an analogous curved surface.

INDUSTRIAL APPLICABILITY

Referring to the drawings generally, when engine 10 is operated gas exchange valves 28 and 29 may open and close against valve seat inserts 38, with a closing force resulting from a return spring bias and fluid pressures in cylinder 14 and/or the respective gas exchange conduits 24 and 26. In certain earlier strategies valve seat inserts were interference-fitted along an entirety, or substantially an entirety, of an axial length of the seat insert within the engine head. As a result, the relatively tight fit and full interference between components can result in the engine head itself limiting elastic deformation of the valve seat inserts in response to valve contact. According to the present disclosure, valve seat inserts can be expected to elastically deform or flex radially outward when the gas exchange valve contacts and pushes against the respective valve seating surface. Stiffness relief channels 62 and 162 can thus be understood to limit stiffness of valve seat inserts 38, 138, in a manner that is not available in designs having a full length interference fit.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An engine head assembly comprising:

an engine head including a fireside surface structured to face a cylinder in an engine, and the engine head having formed therein a valve seat bore, and a gas exchange conduit connecting to the valve seat bore;

a valve seat insert including a valve seating surface defining a center axis, a first axial end abutting the engine head within the valve seat bore, and a second axial end;

a gas exchange valve including a valve head, and being movable between a closed valve position where the valve head contacts the valve seating surface, and an open valve position;

the valve seat insert further including an inner peripheral surface extending circumferentially around the valve seat center axis and forming a throat, for communicating gases between the gas exchange conduit and the cylinder, and an outer peripheral surface;

the outer peripheral surface including an upper section adjacent to the first axial end and interference-fitted with the engine head within the valve seat bore, and a lower section extending between the upper section and the second axial end; and a stiffness relief channel extends radially between the lower section of the outer peripheral surface and the engine head, the stiffness relief channel being circumferential of the valve seat insert and opening in a direction of the fireside surface, and the stiffness relief channel is continuous from the upper section of the outer peripheral surface to the second axial end.

2. The engine head assembly of claim 1 wherein the engine head includes an inner cylindrical bore surface forming the valve seat bore, and the lower section of the outer peripheral surface forms a relief cutout in the valve seat insert that, together with the inner cylindrical bore surface, forms the stiffness relief channel.

3. The engine head assembly of claim 2 wherein the lower section of the outer peripheral surface is cylindrical and concentric with the inner cylindrical bore surface, and the stiffness relief channel has a uniform profile of rotation circumferentially around the center axis.

4. The engine head assembly of claim 2 wherein:

the relief cutout has a radial width dimension, and an axial length dimension that is greater than the radial width dimension; and the axial length dimension is less than an interference-fitted axial length of the upper section with the engine head.

5. The engine head assembly of claim 4 wherein the first axial end includes a planar end surface located radially outward of the valve seating surface, and the lower section of the outer peripheral surface and the planar end surface form a common edge.

6. The engine head assembly of claim 4 wherein the valve seating surface defines a seat angle, relative to the center axis, that is from about 19° to about 45°, and has a seat length dimension, and wherein the radial width dimension is about 50% or less of the seat length dimension.

7. The engine head assembly of claim 4 wherein:

the valve seating surface advances from the second axial end toward the inner peripheral surface in a seat path having a radial path component and an axial path component; and the axial length dimension is equal to or greater than the axial path component.

8. A valve seat insert for a gas exchange valve controlling gas exchange of a cylinder in an engine comprising:

an annular insert body formed of a metallic material and including an inner peripheral surface, an outer peripheral surface, and a valve seating surface, the valve seating surface defining a center axis extending between a first axial end and a second axial end of the annular insert body;

the inner peripheral surface extending circumferentially around the center axis and forming a throat, for communicating gases between a cylinder in the engine and a gas exchange conduit in an engine head in the engine;

the outer peripheral surface extending circumferentially around the center axis, and including an upper section adjacent the first axial end, and a lower section extending between the upper section and the second axial end;

the upper section having a full outer diameter dimension, and a cylindrical shape, for interference-fitting the annular insert body in a valve seat bore in the engine head;

the lower section having a reduced outer diameter dimension, relative to the upper section, such that the outer peripheral surface is stepped radially inward from the upper section to the lower section, and forms a relief cutout for limiting a stiffness of the valve seat insert, the relief cutout having a radial width dimension and a first axial length dimension, and the upper section having a second axial length dimension;

the first axial length dimension is greater than the radial width dimension and less than the second axial length dimension; and the relief cutout is continuous from the upper section of the outer peripheral surface to the second axial end.

9. The valve seat insert of claim 8 wherein the valve seating surface advances from the second axial end toward the inner peripheral surface in a seat path and at a seat angle, relative to a plane perpendicular to the center axis, that is from about 19° to about 45°.

10. The valve seat insert of claim 9 wherein the seat path has a radial path component and an axial path component, and the relief cutout has an axial length dimension that is equal to or greater than the axial path component.

11. The valve seat insert of claim 8 wherein the lower section of the outer peripheral surface is cylindrical and concentric with the upper section, and the relief cutout has a uniform profile of rotation circumferentially around the center axis.

12. The valve seat insert of claim 8 wherein the second axial end includes a planar end surface located radially outward of the valve seating surface.

13. The valve seat insert of claim 12 wherein the lower section of the outer peripheral surface and the planar end surface form a common edge.

14. The valve seat insert of claim 8 wherein the valve seating surface defines a seat angle, relative to a plane perpendicular to the center axis, that is from about 19° to about 45°.

15. The valve seat insert of claim 14 wherein the valve seating surface has a seat length dimension, and wherein the radial width dimension is about 50% or less of the seat length dimension.

16. The valve seat insert of claim 15 wherein the seat length dimension is from about 2 millimeters to about 5 millimeters, and the radial width dimension is about 25% or less of the seat length dimension.

17. A valve seat insert for a gas exchange valve controlling gas exchange of a cylinder in an engine comprising:

an annular insert body formed of a metallic material and including an inner peripheral surface, an outer peripheral surface, and a valve seating surface, the valve seating surface defining a center axis extending between a first axial end and a second axial end of the annular insert body;

the inner peripheral surface extending circumferentially around the center axis and forming a throat, for communicating gases between a cylinder in the engine and a gas exchange conduit in an engine head in the engine;

the outer peripheral surface extending circumferentially around the center axis, and including an upper section adjacent the first axial end, and a lower section;

the upper section having a full outer diameter dimension, and a cylindrical shape, for interference-fitting the annular insert body in a valve seat bore in the engine head; and the lower section having a reduced outer diameter dimension, relative to the upper section, and forming a relief cutout that is continuous from the upper section of the outer peripheral surface to the second axial end.

18. The valve seat insert of claim 17 wherein:

the relief cutout has a radial width dimension and a first axial length dimension that is greater than the radial width dimension;

the valve seating surface has a seat length dimension, and the radial width dimension is less than the seat length dimension; and the upper section of the outer peripheral surface has a second axial length dimension that is greater than the first axial length dimension.

* * * * *